US009139999B2

(12) United States Patent
Nicholls et al.

(10) Patent No.: US 9,139,999 B2
(45) Date of Patent: Sep. 22, 2015

(54) PIVOTING HANGER ASSEMBLY

(71) Applicants: Jerome Charles Nicholls, Sudbury (CA); Kenneth James O'Malley, Sudbury (CA)

(72) Inventors: Jerome Charles Nicholls, Sudbury (CA); Kenneth James O'Malley, Sudbury (CA)

( * ) Notice: Subject to any disclaimer, the term of this patent is extended or adjusted under 35 U.S.C. 154(b) by 0 days.

(21) Appl. No.: 13/684,377

(22) Filed: Nov. 23, 2012

(65) Prior Publication Data

US 2014/0144098 A1 May 29, 2014

(51) Int. Cl.

| | |
|---|---|
| ***E04B 1/26*** | (2006.01) |
| ***E04G 21/14*** | (2006.01) |
| *E04B 5/43* | (2006.01) |
| *E04H 9/02* | (2006.01) |
| *E04B 5/12* | (2006.01) |

(52) U.S. Cl.

CPC ..... *E04B 1/2612* (2013.01); *E04G 21/14* (2013.01); *E04B 5/12* (2013.01); *E04B 5/43* (2013.01); *E04B 2001/2616* (2013.01); *E04H 9/023* (2013.01)

(58) Field of Classification Search

CPC . E04B 1/26; E04B 1/2604; E04B 2001/2616; E04B 2001/2636; E04B 2001/2644

USPC ..... 52/702, 713, 714, 289

See application file for complete search history.

(56) References Cited

U.S. PATENT DOCUMENTS

| | | | | | |
|---|---|---|---|---|---|
| 1,785,791 | A | * | 12/1930 | Ropp | 52/702 |
| 1,875,805 | A | * | 9/1932 | Dickson | 5/294 |
| 2,167,413 | A | * | 7/1939 | Bartlett | 249/23 |
| 2,280,121 | A | * | 4/1942 | Green | 403/170 |
| 2,629,906 | A | * | 2/1953 | Holmes | 403/73 |
| 3,693,929 | A | | 9/1972 | Martin | |
| 3,861,104 | A | * | 1/1975 | Bower | 52/283 |
| 4,124,962 | A | | 11/1978 | Lancelot et al. | |
| 4,148,164 | A | | 4/1979 | Humphrey | |
| 4,158,940 | A | | 6/1979 | Lancelot et al. | |
| 4,261,155 | A | | 4/1981 | Gilb | |
| 4,449,335 | A | | 5/1984 | Fahey | |
| 4,531,334 | A | | 7/1985 | Nylander et al. | |
| 4,765,108 | A | * | 8/1988 | Lapish | 52/379 |
| 4,856,252 | A | | 8/1989 | Cornell | |
| 4,893,772 | A | * | 1/1990 | Scott | 248/235 |
| 4,893,961 | A | * | 1/1990 | O'Sullivan et al. | 403/232.1 |
| 5,004,369 | A | | 4/1991 | Young | |

(Continued)

FOREIGN PATENT DOCUMENTS

| | | | | |
|---|---|---|---|---|
| CA | 1102087 | A1 | 6/1981 | |
| CA | 2774271 | A1 | 3/2011 | |
| EP | 357273 | A1 * | 3/1990 | E04B 1/26 |

OTHER PUBLICATIONS

Canadian Office Action for Canadian Patent Application No. 2,796,340, dated Jul. 4, 2013.

(Continued)

*Primary Examiner* — Elizabeth A Plummer

(74) *Attorney, Agent, or Firm* — Bereskin & Parr LLP/S.E.N.C.R.L., s.r.l.

(57) ABSTRACT

Apparatus and methods for pivotally coupling a joist to a fixed structure are described. In one embodiment, a support hanger assembly comprises a joist bracket for fastening to the joist, a support bracket comprising a support bracket base configured to be mounted to the fixed structure and at least one flange extending from the support bracket base for coupling to the joist bracket, and a connecting member for pivotally coupling the joist bracket and the support bracket.

15 Claims, 12 Drawing Sheets

(56) References Cited

U.S. PATENT DOCUMENTS

| | | | | |
|---|---|---|---|---|
| 5,035,099 | A * | 7/1991 | Lapish | 52/713 |
| 5,058,358 | A * | 10/1991 | Stratton | 52/702 |
| 5,111,632 | A | 5/1992 | Turner | |
| 5,240,342 | A | 8/1993 | Kresa | |
| 5,845,453 | A * | 12/1998 | Goya | 52/702 |
| 6,814,522 | B1 * | 11/2004 | Daniel, III | 403/162 |
| 6,931,813 | B2 * | 8/2005 | Collie | 52/713 |
| 7,412,804 | B1 | 8/2008 | Bussinger | |
| 7,775,478 | B2 | 8/2010 | Wood et al. | |
| 2007/0102603 | A1 * | 5/2007 | Newell | 248/219.2 |
| 2007/0292204 | A1 * | 12/2007 | Hackney | 403/93 |
| 2008/0172976 | A1 | 7/2008 | Carney et al. | |
| 2008/0202059 | A1 * | 8/2008 | McCollough | 52/702 |
| 2008/0237421 | A1 | 10/2008 | Szpotowski | |
| 2009/0151282 | A1 * | 6/2009 | Loayza | 52/261 |

OTHER PUBLICATIONS

Canadian Notice of Allowance for Canadian Patent Application No. 2,796,340, dated Oct. 28, 2013.

* cited by examiner

PIVOTING HANGER ASSEMBLY

FIELD

Embodiments disclosed herein relate generally to a support hanger assembly for pivotally securing one or more joists to a fixed structure, and to methods of securing one or more joists to a fixed structure using the support hanger assembly.

BACKGROUND

Support hangers (also known as joist hangers) are commonly used to provide a fixed structural connection between a joist and a fixed structural assembly.

SUMMARY

According to one broad aspect, some embodiments of the invention provide a support hanger assembly for pivotally coupling a joist to a fixed structure, the support hanger assembly comprising: a joist bracket for fastening to the joist; a support bracket comprising: a support bracket base configured to be mounted to the fixed structure, and at least one flange extending from the support bracket base for coupling to the joist bracket; and a connecting member for pivotally coupling the joist bracket and the support bracket.

In some embodiments, the joist bracket has at least one joist connector bore, each of the at least one flange includes a support connector bore; and pivotally coupling the joist bracket and the support bracket comprises disposing the connecting member through the at least one joist connector bore and the support connector bore.

In some embodiments, the support hanger assembly is configured such that when: the joist bracket is fastened to the joist, the support bracket is mounted to the fixed structure, and the joist bracket is pivotally coupled to the support bracket, the joist bracket can be pivoted relative to the support bracket without significant torque being transferred to the fixed structure.

In some embodiments, the joist bracket comprises a joist bracket base and a joist plate extending from the joist bracket base, and wherein the joist plate has the at least one joist connector bore extending therethrough.

In some embodiments, the joist bracket comprises a joist bracket base and two joist plates extending from the joist bracket base, and wherein each joist plate has one of the at least one joist connector bore extending therethrough.

In some embodiments, the joist bracket base is configured to support a lower surface of the joist when the joist bracket is fastened to the joist.

In some embodiments, the at least one flange comprises at least two flanges, and wherein the at least two flanges are spaced apart for supporting the joist bracket therebetween.

In some embodiments, the connecting member is further disposed through a bore in the joist.

In some embodiments, the connecting member includes a bolt.

In some embodiments, the connecting member includes a bearing.

In some embodiments, the joist bracket further comprises at least one bearing, and wherein the at least one joist connector bore is an inner bore of the at least one bearing.

In some embodiments, the at least one bearing comprises a spherical bearing.

According to another broad aspect, some embodiments of the invention provide a support hanger assembly for pivotally coupling two or more joists to a fixed structure, the support hanger assembly comprising: two or more joist brackets, each configured to be fastened to one of the two or more joists; at least two support brackets, each support bracket comprising a support bracket base configured to be mounted to the fixed structure, and at least one flange extending from the support bracket base for coupling to the two or more joist brackets; and a connecting member for pivotally coupling the two or more joist brackets and the at least two support brackets.

In some embodiments, each joist bracket has at least one joist connector bore, each flange includes a support connector bore; and pivotally coupling the two or more joist brackets and the at least two support brackets comprises disposing the connecting member through the at least one joist connector bore and the support connector bores.

In some embodiments the support hanger assembly is configured such that when: the two or more joist brackets are each fastened to one of the two or more joists, the at least two support brackets are mounted to the fixed structure, and the two or more joist brackets are pivotally coupled to the at least two support brackets, the two or more joist brackets can be pivoted relative to the at least two support brackets without significant torque being transferred to the fixed structure.

In some embodiments each of the two or more joist brackets comprises a joist bracket base and a joist plate extending from the joist bracket base, and wherein each joist plate has the at least one the joist connector bore extending therethrough.

In some embodiments, each of the two or more joist brackets comprises a joist bracket base and two joist plates extending from the joist bracket base, and wherein each joist plate has the at least one the joist connector bore extending therethrough.

In some embodiments, each joist bracket base is configured to support a lower surface of one of the two or more joists when that joist bracket is fastened to one of the two or more joists.

In some embodiments, the connecting member is further disposed through a bore in each of the two or more joists.

In some embodiments, the connecting member includes a bolt.

In some embodiments, the connecting member includes a bearing.

In some embodiments, the connecting member includes a pin.

In some embodiments, the two or more joist brackets each further comprise at least one bearing, and each of the at least one joist connector bore is an inner bore of the at least one bearing.

In some embodiments, the at least one bearing comprises a spherical bearing.

According to another broad aspect, some embodiments of the invention provide a support hanger assembly for pivotally coupling a joist to a fixed structure, the support hanger assembly comprising: a joist bracket for fastening to the joist, the joist bracket having a joist connector ball; a support bracket comprising: a support bracket base configured to be mounted to the fixed structure, and at least two flanges extending from the support bracket base, at least a portion of a surface of each flange cooperatively defining a support connector socket for coupling to the joist connector ball; wherein the joist bracket and support bracket may be pivotally coupled by disposing the joist connector ball in the support connector socket.

In some embodiments, the joist is a floor joist of a deck.

According to another broad aspect, some embodiments of the invention provide a method for pivotally coupling a joist to a fixed structure, the method comprising: fastening a joist bracket to the joist, the joist bracket having a joist connector bore; mounting a support bracket to the fixed structure, the support bracket comprising a support bracket base and at least two flanges extending from the support bracket base for coupling to the joist bracket, each flange having a support connector bore extending therethrough; positioning the joist bracket relative to the support bracket so that the joist connector bore and the at least two support connector bores are axially aligned, and disposing a connecting member through the joist connector bore and the at least two support connector bores to pivotally couple the joist bracket to the support bracket, such that the joist bracket can be pivoted relative to the support bracket without significant torque being transferred to the fixed structure.

According to another broad aspect, some embodiments of the invention provide a method for pivotally coupling a joist to a fixed structure, the method comprising: fastening a joist bracket to the joist; mounting a support bracket to the fixed structure, the support bracket comprising a support bracket base and at least one flange extending from the support bracket base for coupling to the joist bracket; and coupling the joist bracket to the support bracket such that the joist bracket and support bracket remain pivotally connected when in use.

In some embodiments, the joist bracket has at least one joist connector bore, each of the at least one flange includes a support connector bore; and coupling the joist bracket to the support bracket comprises disposing a connecting member through the at least one joist connector bore and the support connector bore such that the joist bracket can be pivoted relative to the support bracket without significant torque being transferred to the fixed structure.

According to another broad aspect, some embodiments of the invention provide for a method for constructing an attached structure including a plurality of joists, wherein the attached structure is pivotally coupled to a fixed structure, the method comprising: fastening a plurality of joist brackets to the joists; mounting one or more support brackets to the fixed structure, each support bracket comprising a support bracket base and at least one flange extending from the support bracket base for coupling to at least one of the joist brackets; and coupling the joist brackets to the support brackets such that the joist brackets and support brackets remain pivotally connected when in use.

In some embodiments, each joist bracket has at least one joist connector bore, each of the flanges includes a support connector bore; and coupling each of the joist brackets to at least one of the support brackets comprises disposing a connecting member through the joist connector bore of each joist bracket and the support connector bore of one or more support brackets.

In some embodiments, at least one of the joist brackets comprises a joist bracket base and a joist plate extending from the joist bracket base, and wherein the joist plate has the at least one joist connector bore extending therethrough.

In some embodiments, at least one of the joist brackets comprises a joist bracket base and two joist plates extending from the joist bracket base, and wherein each joist plate has one of the at least one joist connector bore extending therethrough.

In some embodiments, the joist bracket base is configured to support a lower surface of the joist when the joist bracket is fastened to the joist.

In some embodiments, the support bracket comprises at least two flanges, and wherein the at least two flanges are spaced apart for supporting the joist bracket therebetween.

In some embodiments, the connecting member is further disposed through a bore in the joist.

In some embodiments, the connecting member includes a bolt.

In some embodiments, the connecting member includes a pin.

In some embodiments, the connecting member includes a bearing.

In some embodiments, at least one of the joist brackets further comprises at least one bearing, and wherein the at least one joist connector bore is an inner bore of the at least one bearing.

In some embodiments, the at least one bearing comprises a spherical bearing.

In some embodiments, the attached structure is selected from the group consisting of: a deck, awning, pergola and dock.

BRIEF DESCRIPTION OF THE DRAWINGS

For a better understanding of embodiments of the systems and methods described herein, and to show more clearly how they may be carried into effect, reference will be made, by way of example, to the accompanying drawings in which.

DESCRIPTION OF EXEMPLARY EMBODIMENTS

Figure 1A:
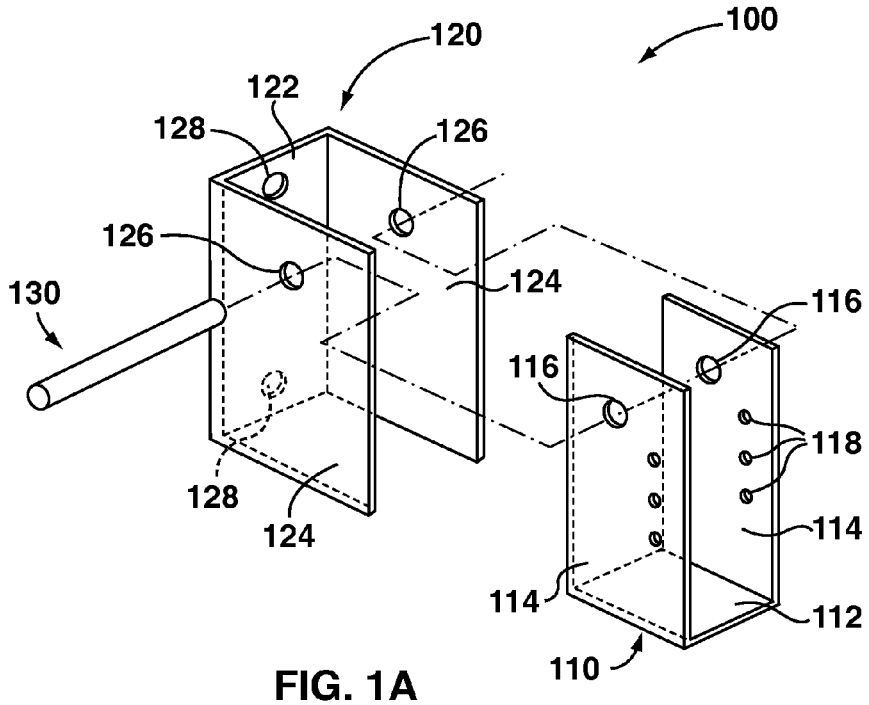
FIG. 1A is an exploded perspective view showing a support hanger assembly according to one embodiment.

The construction industry has utilized many types of fixed support hangers to support joists or other types of structural members, light metal framing hangers or joist hangers being perhaps the most common example. However, fixed support hangers do not allow for relative movement between the attached structural members. In fact, support hangers are often designed to minimize or eliminate relative motion between the attached structural members.

For example, a typical joist hanger comprises a rigid frame for securing a joist to a supporting member; once the joist hanger has been secured to both the joist and the supporting member (typically by nailing), relative motion between the joist and the supporting member is prevented. While some support hangers provide for a limited degree of relative movement between a joist and a supporting member during installation (e.g. to adjust the slope and/or skew between the joist and the structural member), these support hangers are designed to provide a fixed, rigid connection following installation.

However, in some situations it may be desirable to provide a pivoting connection to allow relative movement between a joist and a supporting member following installation.

For example, in regions with soil susceptible to frost heaving, it may be desirable to provide a continuously pivoting connection between a fixed structure such as a house and the floor joists of an attached structure such as a deck, awning, pergola or dock, so that a support pier for a distal end of the attached structure (i.e. distal to the connection between the fixed structure and the attached structure) can be vertically displaced relative to the fixed structure without significant torque being transferred to the fixed structure.

To prevent structural damage resulting from frost heaving, foundations typically include footings located below the frost line. In many jurisdictions, local building codes provide minimum requirements for the design and installation of foundations in frost susceptible soil; these minimum requirements are generally more onerous than for foundations in non-frost susceptible soil.

To reduce the potential impact of frost heave, it is common practice that when attaching a new structure, such as a deck, to a structure comprising a frost heave-resistant foundation, such as a house, using a rigid connection (e.g. a connection using rigid support hangers), the foundation for the new structure is also provided with a frost heave-resistant foundation. This may be a building code requirement in some jurisdictions. For example, if a deck is attached to a house—either as part of a new house construction, or as a subsequent addition—all of the deck supports may require frost heave-resistant piers and footings. In most cases, installing frost heave-resistant footings adds significant complexity and cost to the installation of a deck.

If distal deck footings are not provided with frost heave-resistant foundations, the relative vertical motion between these deck footings and the structure to which the deck is attached (due to frost heave) may impart a significant torque to the rigid connection between the deck joists and the structure to which the deck is attached. This torque may cause distress to the fixed structure and/or the deck.

In the past, this issue was addressed in one of two ways: either i) the distal deck supports were provided with frost heave-resistant footings, often increasing the cost of installing the deck; or ii) the deck was not attached to the house at all. While providing a 'free floating' deck adjacent to, but not attached to, a house may eliminate the requirement for frost heave-resistant footings for the deck supports, such a deck may not provide an aesthetically pleasing interface between the deck and the house.

Also, providing a 'free floating' deck adjacent to, but not attached to, a house typically requires additional support piers and columns to be installed to support the portion of the deck proximate to the house, adding expense in material and installation costs. Also, support piers located adjacent to the foundation of a house may experience different degrees of frost heave relative to support piers located for a distal end of the attached deck (i.e. distal to the connection between the house and the deck). For example, support piers located adjacent to the foundation of the house may not rise as much due to frost heave relative to deck supports located away from the house. In this case, it is possible that the deck may pivot or jam against the house, which may cause distress to the house and/or the deck.

In contrast, unlike typical support hangers, which provide a fixed/static connection between a joist and a fixed structure after installation, embodiments disclosed herein provide a pivotal coupling between a joist and a fixed structure when in use, so that when the joist is coupled to the fixed structure via the support hanger assembly, the joist can be pivoted relative to the fixed structure without significant torque being transferred to the fixed structure.

By providing a pivotal coupling, relative movement between a joist and a supporting member may be accommodated after installation. For example, by securing the joists of a deck to a house using one or more support hanger assemblies as disclosed herein, the requirement to provide frost heave-resistant footings for distal deck supports may be eliminated. In this case, the pivotal coupling may accommodate distal deck supports that 'float' up and down due to frost heaving, without causing distress to the deck and/or the fixed structure. This may greatly simplify and/or reduce the cost of installing decks in regions with soil susceptible to frost heaving.

Aspects and features of various embodiments will be described in greater detail below. Embodiments of the present application provide support hangers and methods for pivotally coupling a joist to a fixed structure. In order to aid in the understanding of the general methods, specific embodiments are described below as an example of the general method; it is to be understood that alternate embodiments are feasible.

Figure 1B:
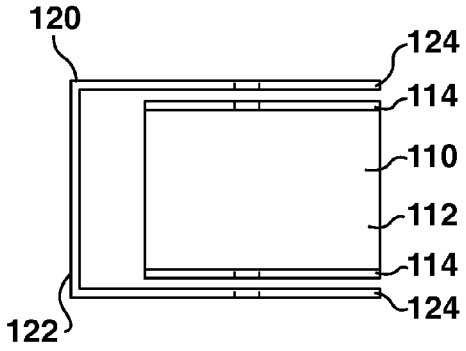
FIG. 1B is a plan view showing a support hanger assembly according to one embodiment.
Figure 1C:
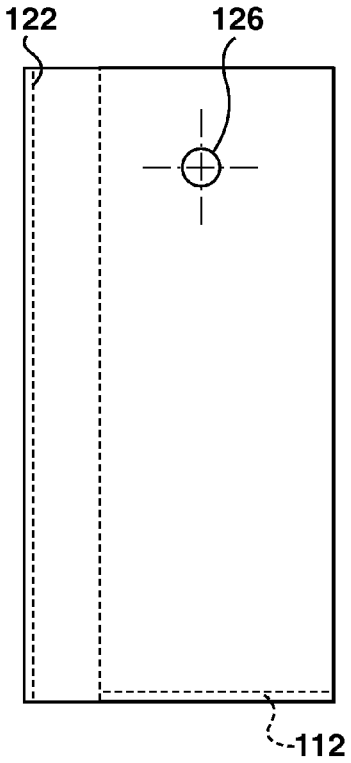
FIG. 1C is a side view showing a support hanger assembly according to one embodiment.

Referring first to FIGS. 1A-1C, support hanger assembly 100 includes joist bracket 110 and support bracket 120. At least one joist connector bore 116 extends through joist bracket 110, and support connector bores 126 extend through each of at least two flanges 124 of the support bracket 120. In use, joist bracket 110 is positioned relative to support bracket 120 so that the at least one joist connector bore 116 and the support connector bores 126 are aligned, and connecting member 130 is inserted through joist connector bores 116 and support connector bores 126 to pivotally couple joist bracket 110 to support bracket 120. That is, when coupled by connecting member 130, joist bracket 110 is able to pivot back and forth about connecting member 130 relative to support bracket 120.

Figure 2:
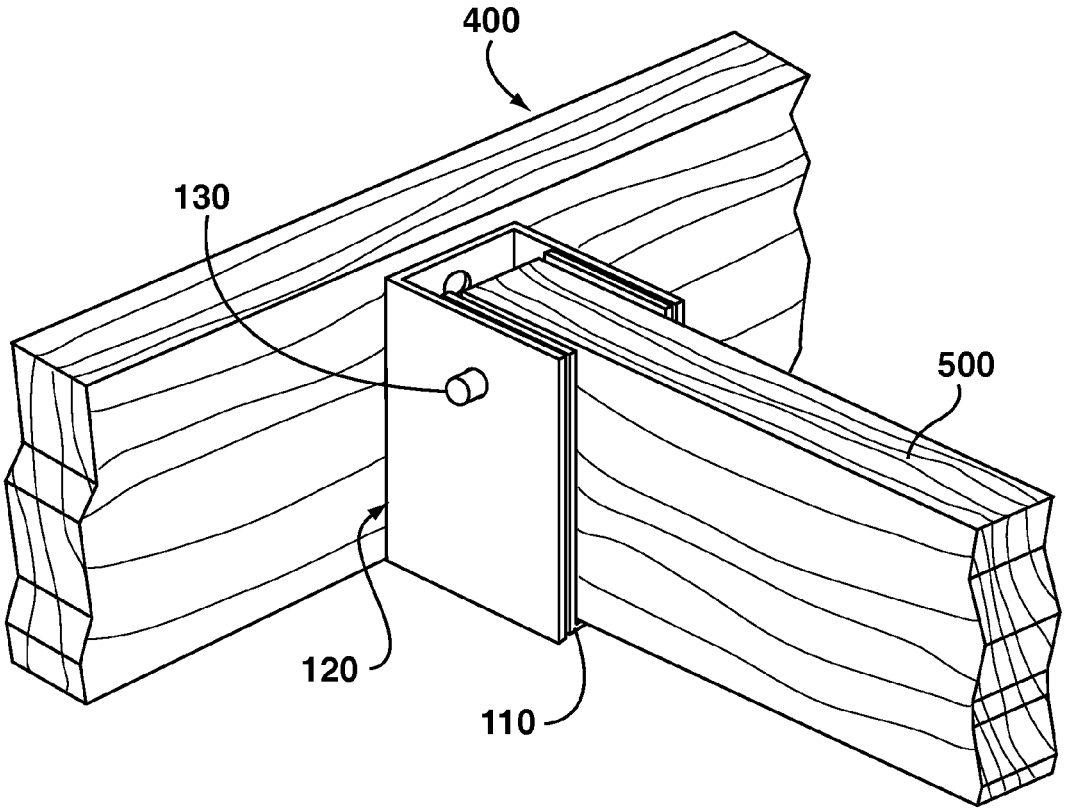
FIG. 2 is a perspective view showing a joist pivotally coupled to a fixed structure using a support hanger assembly according to one embodiment.

As shown in FIG. 2, when support bracket 120 is mounted to a fixed structure 400 such that the axis of rotation provided by connecting member 130 is generally horizontal, a distal end of joist 500—fastened to joist bracket 110—may be raised or lowered in a vertical direction relative to fixed structure 400 without significant torque being transferred to fixed structure 400 via support assembly 100. In general, support bracket 120 permits movement of the joist bracket in a direction generally perpendicular to the direction of the connection member.

For example, if the fixed structure is a ribbon joist attached to a house having a foundation designed to minimize or eliminate vertical displacement due to frost heave, connecting the floor joists of a deck using one or more support assemblies 100 may obviate the need to provide foundations designed to minimize or eliminate vertical displacement due to frost heave for one or more distal deck supports, as any differential vertical movement between distal ends of the deck joists relative to the ribbon joist will result in the deck joists pivoting in the support bracket without significant torque being transferred to the fixed structure. As a result, the one or more distal deck supports may not require piers connected to footings installed below the frost line.

Figure 3A:
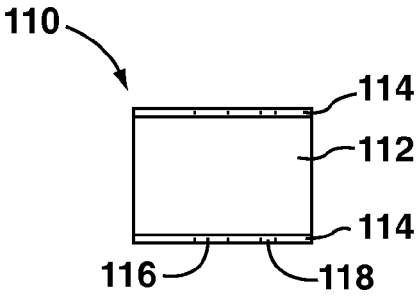
FIG. 3A is a plan view showing the joist bracket shown in FIGS. 1A-C.
Figure 3B:
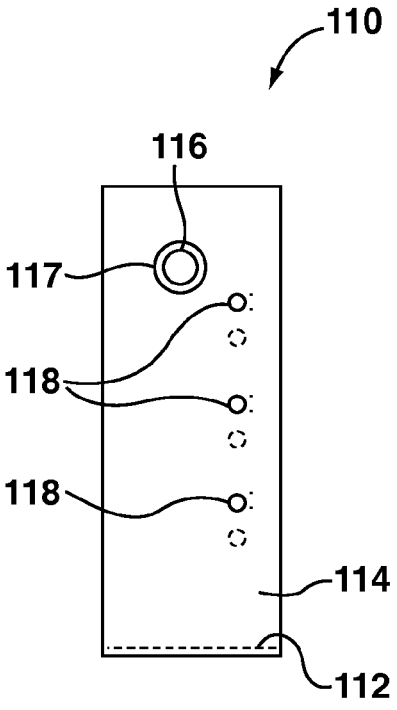
FIG. 3B is a side view showing the joist bracket shown in FIGS. 1A-C.
Figure 3C:
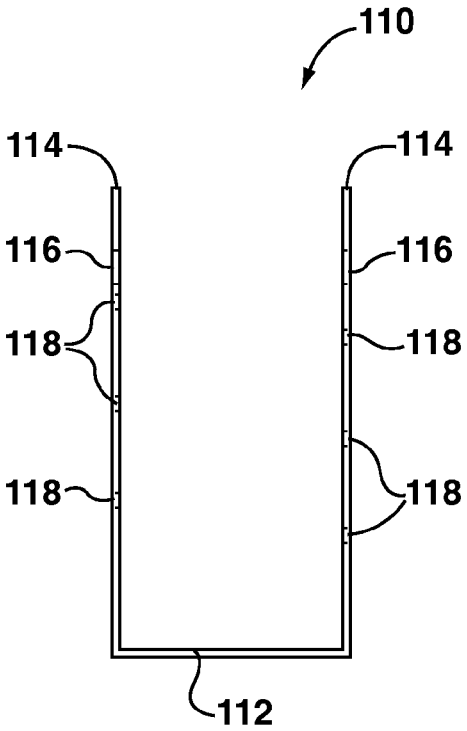
FIG. 3C is an end view showing the joist bracket shown in FIGS. 1A-C.

As shown in FIGS. 3A-3C, joist bracket 110 may comprise joist bracket base 112 and a pair of joist plates 114 extending from the joist bracket base 112. That is, the joist bracket base 112 and a pair of joist plates 114 may form a substantially U-shaped joist bracket 110. Such a U-shaped joist bracket may be dimensioned to receive an end of a typical 2×8 or 2×10 floor joist.

For example, the joist bracket base 112 may be wide enough to provide a clearance of 1⅝ inches between inner faces of joist plates 114, and joist plates 114 may extend approximately 7 inches from the joist bracket base 112. In some embodiments, joist bracket base 112 may be 2 inches by 2⅝ inches deep (i.e. joist plates 114 may be approximately 7 inches tall by 2⅝ inches deep). Those skilled in the art will understand that any suitable dimensions may be selected based on loading or other requirements of a particular application.

In some embodiments, as shown in FIG. 3B, joist bracket 110 may also include bearing 117, and joist connector bore 116 may be an inner bore of this bearing. This may decrease the friction between joist bracket 110 and connecting member 130 as joist bracket 110 pivots relative to support bracket 120.

In some embodiments, bearing 117 may be a spherical bearing. By providing a spherical bearing, joist bracket 110 may more readily accommodate one or more components of rotation (e.g. yaw or roll) in addition to pivoting (e.g. pitching) about the axis of connecting member 130.

In addition to joist connector bore 116, joist plates 114 may also have one or more fastener bores 118 to accommodate mechanical fasteners (e.g. nails, screws) for securing the joist bracket 110 to joist 500. Any suitable size of fastener bore may be provided. For example, ⅜ inch diameter bores may be provided, for accommodating 2" to 3" lag screws.

Fastener bores 118 are preferably spaced apart along the joist plate 114, and in embodiments where joist bracket 110 comprises more than one joist plate, fastener bores 118 are preferably offset such that there is no interference between fasteners inserted through opposing joist plates. Although three bores 118 are illustrated for each joist plate 114, those skilled in the art will understand that any suitable number of bores 118 may be provided.

Figure 4A:
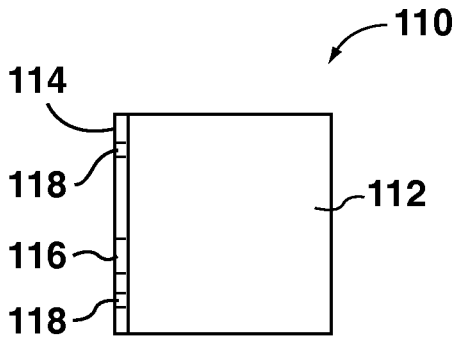
FIG. 4A is a plan view showing a joist bracket according to an embodiment.
Figure 4B:
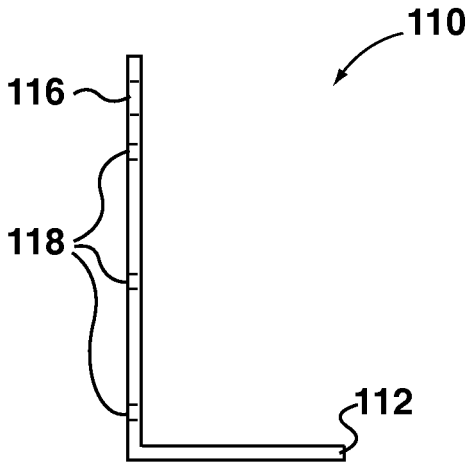
FIG. 4B is an end view showing the joist bracket shown in FIG. 4A.
Figure 4C:
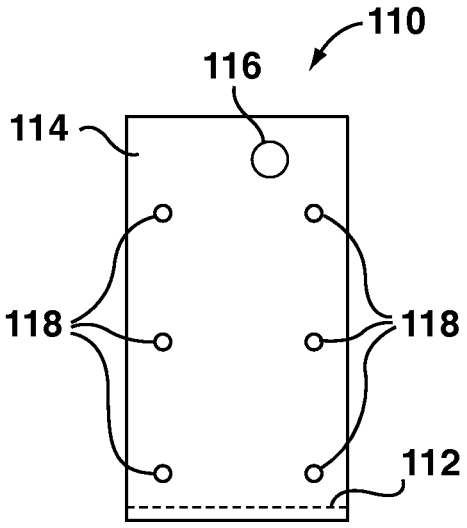
FIG. 4C is a side view showing the joist bracket shown in FIG. 4A.

As shown in FIGS. 3A-3C, the joist bracket base 112 and a pair of joist plates 114 may form a substantially U-shaped joist bracket 110. In other embodiments, only one joist plate 114 may extend from the joist bracket base 112, forming a generally L-shaped joist bracket 110, as shown in FIGS. 4A-4C. Alternatively, joist bracket 110 may consist solely of joist plate 114 (not shown).

Figure 5A:
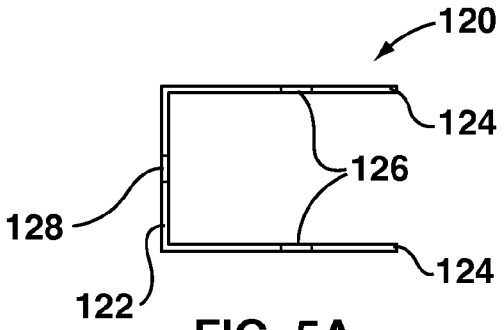
FIG. 5A is a plan view showing a support bracket shown in FIGS. 1A-C.
Figure 5B:
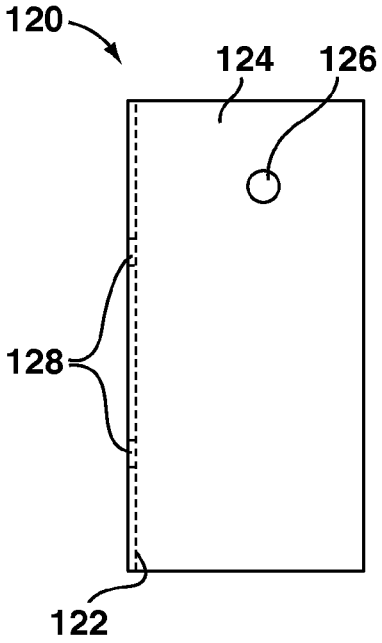
FIG. 5B is a side view showing a support bracket shown in FIGS. 1A-C.
Figure 5C:
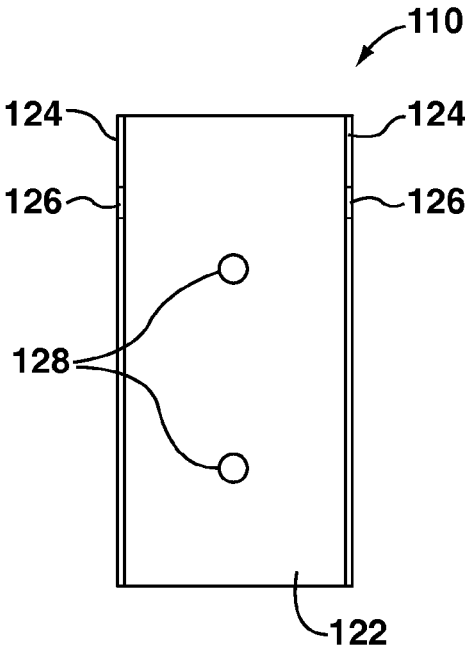
FIG. 5C is an end view showing a support bracket shown in FIGS. 1A-C.

As shown in FIGS. 5A-5C, support bracket 120 may comprise support bracket base 122 and a pair of flanges 124 extending from the support bracket base. That is, support bracket base 122 and flanges 124 may form a substantially C-shaped support bracket 120. Support connector bore 126, dimensioned to receive connecting member 130, extends through each flange 124. Such a C-shaped joist bracket may be dimensioned such that the flanges 124 are spaced apart to receive at least a portion of joist bracket 110 and/or at least a portion of an end of joist 500 therebetween.

For example, the support bracket base 122 may be approximately 2½ inches wide by 7 inches tall, and flanges 124 may extend approximately 3½ inches from the support bracket base 122 (i.e. flanges 124 may be approximately 7 inches tall by 3½ inches deep). Those skilled in the art will understand that any suitable dimensions may be selected based on loading or other requirements of a particular application.

Support bracket base 122 may have one or more fastener bores 128 to accommodate mechanical fasteners (e.g. nails, screws) for securing the support bracket 120 to fixed structure 400. Any suitable size of fastener bore may be provided. For example, 7/16 inch diameter bores may be provided, for accommodating standard 1½ inch joist nails. Fastener bores 128 are preferably spaced apart along the support bracket base 122. Although two bores 128 are illustrated, those skilled in the art will understand that any suitable number of bores 128 may be provided.

Figure 6A:
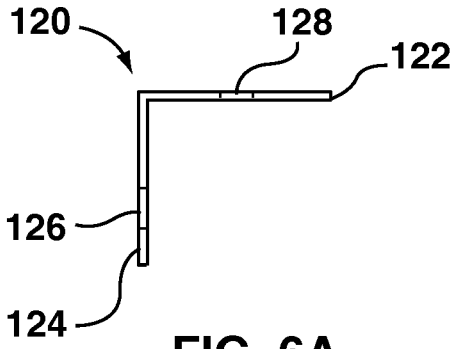
FIG. 6A is a plan view showing a support bracket according to an embodiment.
Figure 6B:
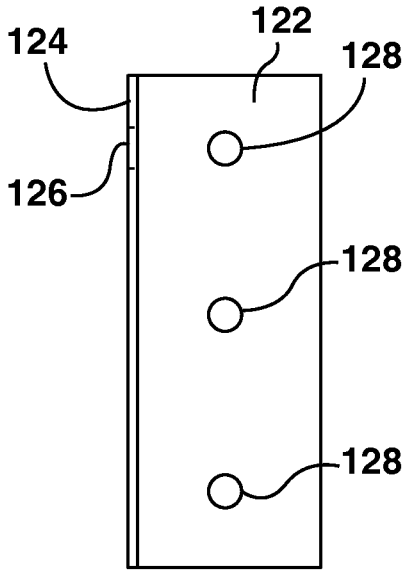
FIG. 6B is an end view showing the support bracket shown in FIG. 6A.
Figure 6C:
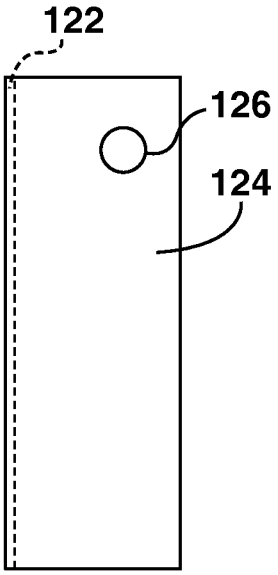
FIG. 6C is a side view showing the support bracket shown in FIG. 6A.

As shown in FIGS. 5A-5C, the support bracket base 122 and at least two flanges 124 may form a substantially C-shaped support bracket 120. In other embodiments, only one flange 124 may extend from the support bracket base 122, forming a generally L-shaped support bracket 120, as shown in FIGS. 6A-6C.

Connecting member 130 may be dimensioned to be received in joist connector bore(s) 116 and support connector bore(s) 126 while allowing joist bracket 110 to pivot back and forth relative to support bracket 120 without significant torque being transferred via support assembly 100.

In some embodiments, connecting member 130 may comprise a bolt with a flared head at one end and threads disposed on the other end for receiving a complementary nut, so that when the threaded end of the bolt is inserted through the joist connector bore(s) 116 and support connector bore(s) 126 and the complementary nut threaded onto the threaded end of the bolt, the flared head and the nut act to retain the connecting member 130 in the joist connector bore(s) 116 and support connector bore(s) 126.

In some embodiments, connecting member 130 may comprise a generally cylindrical shaft with a hole at each end for receiving a retaining member such as a cotter pin, split pin, split ring, etc., so that when the shaft is inserted through the joist connector bore(s) 116 and support connector bore(s) 126, a cotter pin, split pin, split ring, etc. may be used to retain the connecting member 130 in the joist connector bore(s) 116 and support connector bore(s) 126.

In some embodiments, connecting member 130 may comprise a bearing, suitable for reducing the torque required to pivot joist bracket 110 relative to support bracket 120.

In some embodiments, connecting member 130 may also be disposed through a bore in joist 500 that is secured to joist bracket 110, the bore in joist 500 being generally aligned with the joist connector bore(s) 116 of the joist bracket 110.

Figure 7:
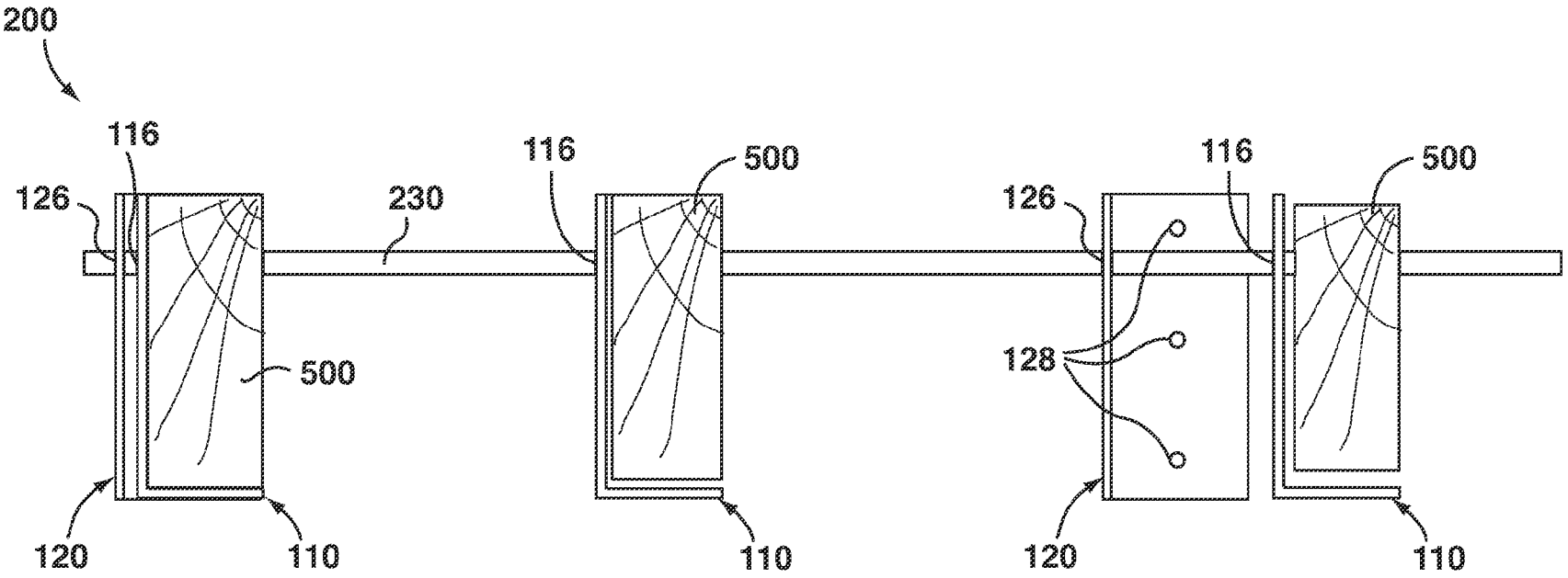
FIG. 7 is an end view showing two or more joists pivotally coupled to a fixed structure using a support hanger assembly according to one embodiment.

In an alternative embodiment shown in FIG. 7, support hanger assembly 200 includes two or more joist brackets 110 and at least two support brackets 120. At least one joist connector bore 116 extends through each joist bracket 110, and support connector bores 126 extend through each of at least two flanges 124 of the support brackets 120. In use, joist brackets 110 are positioned relative to support brackets 120 so that the joist connector bores 116 and the support connector bores 126 are aligned, and connecting member 230 is inserted through joist connector bores 116 and support connector bores 126 to pivotally couple joist brackets 110 to support brackets 120. That is, when coupled by connecting member 230, joist brackets 110 are able to pivot back and forth about connecting member 230 relative to support brackets 120.

In this way, when support brackets 120 are mounted to fixed structure 400 such that the axis of rotation provided by connecting member 230 is substantially horizontal, the distal end of two or more joists 500 fastened to joist brackets 110 may be raised or lowered in a vertical direction relative to fixed structure 400 without significant torque being transferred to fixed structure 400 via support assembly 200.

In some embodiments, two or more joists 500, each fastened to joist brackets 110, may be spaced apart approximately every 16 inches on centre, and support brackets 120 may be spaced apart approximately every 26 inches on centre. In this way, four joist brackets 110 may be coupled to three support brackets 120 using connecting member 230 with a length of approximately 54 inches. Also, a joist bracket 110 will line up with a support bracket 120 approximately every 208 inches. Those skilled in the art will understand that any suitable dimensions may be selected based on loading or other requirements of a particular application.

Figure 8A:
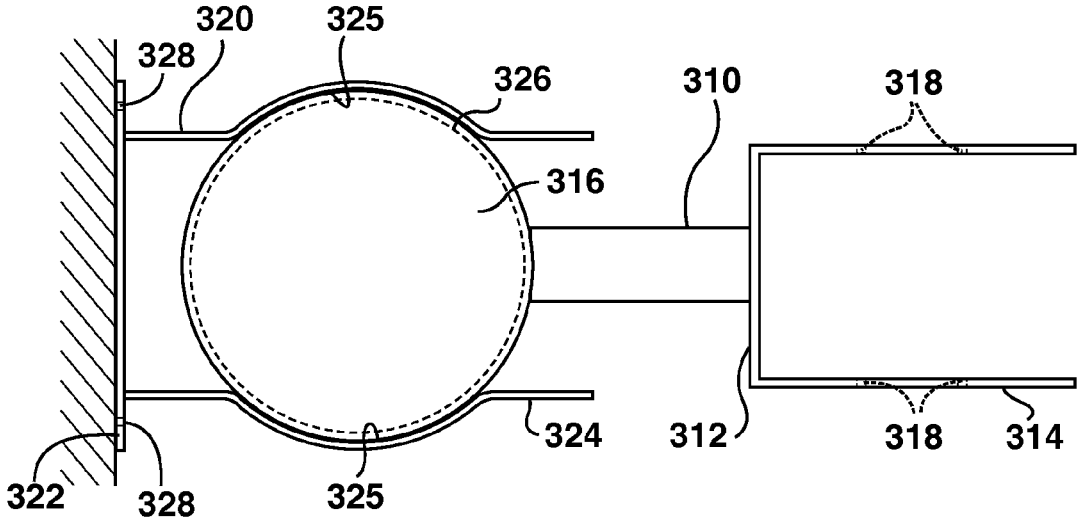
FIG. 8A is a plan view showing a support hanger assembly according to one embodiment.
Figure 8B:
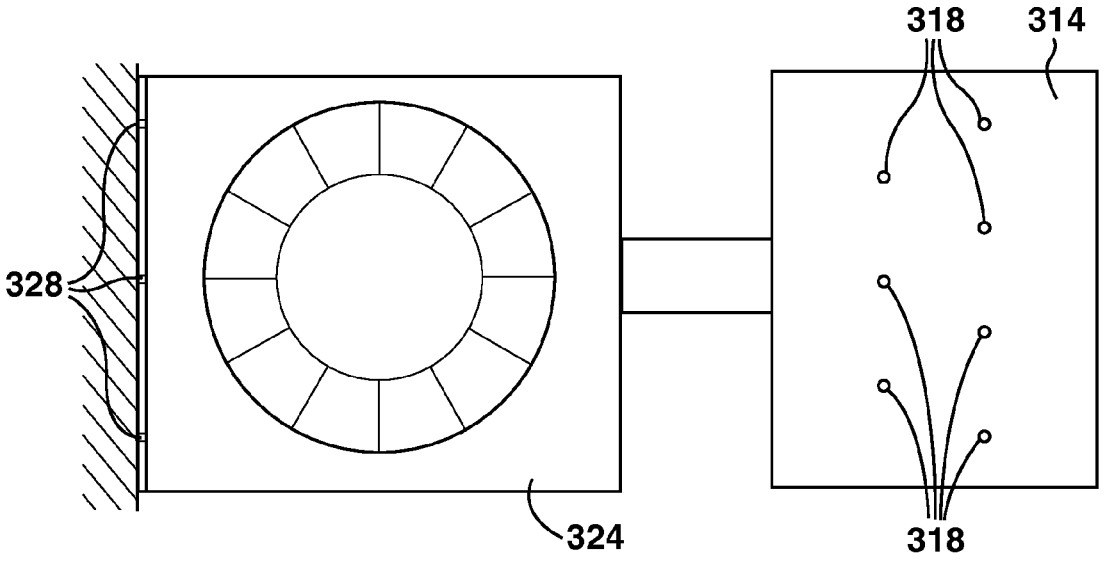
FIG. 8B is a side view showing the support hanger shown in FIG. 8A.

In an alternative embodiment shown in FIGS. 8A-8B, support hanger assembly 300 includes joist bracket 310 and support bracket 320. Joist connector ball 316 extends from joist bracket base 312, and a portion of a surface 325 of each flange 324 cooperatively defines a support connector socket 326 of support bracket 320. In use, joist connector ball 316 is disposed within support connector socket 326 so that joist connector ball 316 is pivotally coupled to support bracket 320. That is, a joist 500 secured to joist bracket 310 is able to pivot back and forth about more than one axis relative to support bracket 320.

Joist bracket 310 may comprise joist bracket base 312 and a pair of joist plates 314 extending from the joist bracket base 312. That is, the joist bracket base 312 and joist plates 114 may form a substantially U-shaped bracket, preferably dimensioned to receive an end of a typical 2×8 or 2×10 floor joist. Joist plates 314 may have one or more fastener bores 318 to accommodate mechanical fasteners (e.g. nails, screws) for securing the joist bracket 310 to joist 500. Any suitable size of fastener bore may be provided.

Support bracket 320 may comprise support bracket base 322 and a pair of flanges 324 extending from the support bracket base. That is, support bracket base 322 and flanges 324 may form a substantially C-shaped support bracket 320. Complementary surfaces 325, dimensioned to cooperatively define support connector socket 326 to receive joist connector ball 316, are provided on each flange 324. Support bracket base 322 may have one or more fastener bores 328 to accommodate mechanical fasteners (e.g. nails, screws) for securing the support bracket 320 to fixed structure 400. Any suitable size of fastener bore may be provided.

Figure 8C:
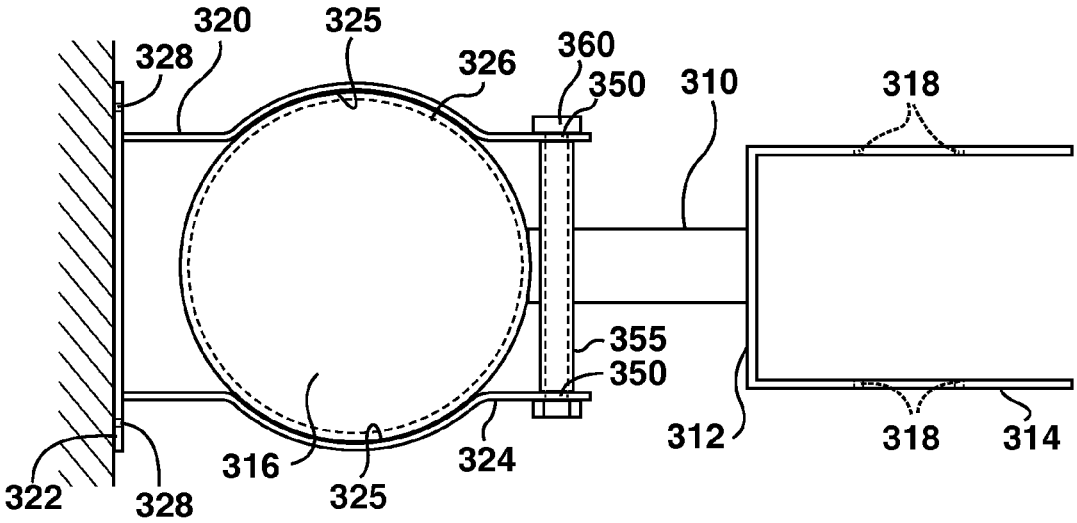
FIG. 8C is a plan view showing a support hanger assembly according to one embodiment.
Figure 8D:
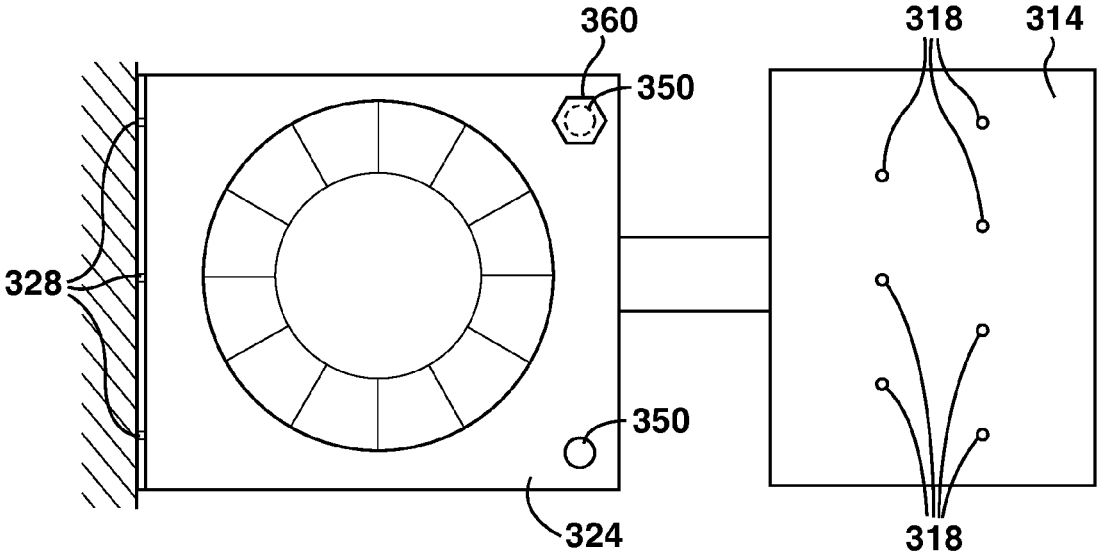
FIG. 8D is a side view showing the support hanger shown in FIG. 8C.

In some embodiments, flanges 324 may be sufficiently flexible to allow joist connector ball 316 to be inserted into support connector socket 326 after support bracket 320 has been mounted to fixed structure 400. As shown in FIGS. 8C and 8D, flanges 324 may also include one or more spacer bores 350. Spacer bores 350 are sized to accommodate a spacer fastener 360 (such as a bolt or other suitable mechanical fastener) that is positioned through spacer bores 350 and a spacer 355. In use, after joist connector ball 316 has been inserted into support connector socket 326, one or more spacers 355 are aligned with one or more spacer bores 350, and spacer fastener(s) 360 are disposed through spacer 355 and spacer bores 350 and secured in position, for example using nuts and/or washers. By providing spacers of a predetermined length, the distance between flanges 326 (and therefore the dimensions of support connector socket 326) can be controlled, providing a coupling between joist bracket 310 and support bracket 320 that is neither too loose nor too tight.

Figure 9:
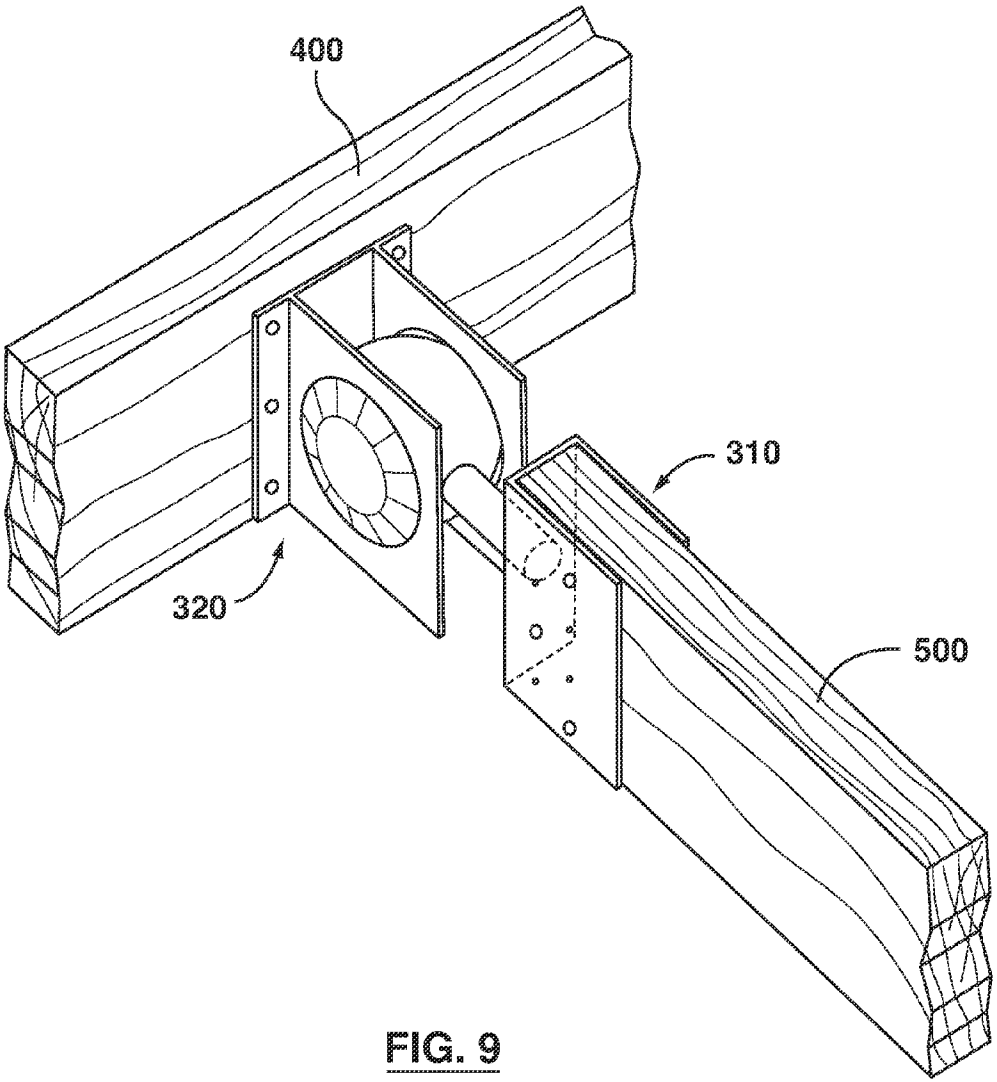
FIG. 9 is a perspective view showing a joist pivotally coupled to a fixed structure using the support hanger assembly of FIG. 8A.

As shown in FIG. 9, when support bracket 320 is mounted to fixed structure 400, a distal end of joist 500 fastened to joist bracket 310 may be raised or lowered in a vertical direction relative to fixed structure 400 and/or displaced in a horizontal direction without significant torque being transferred to fixed structure 400 via support assembly 300.

Figure 10C:
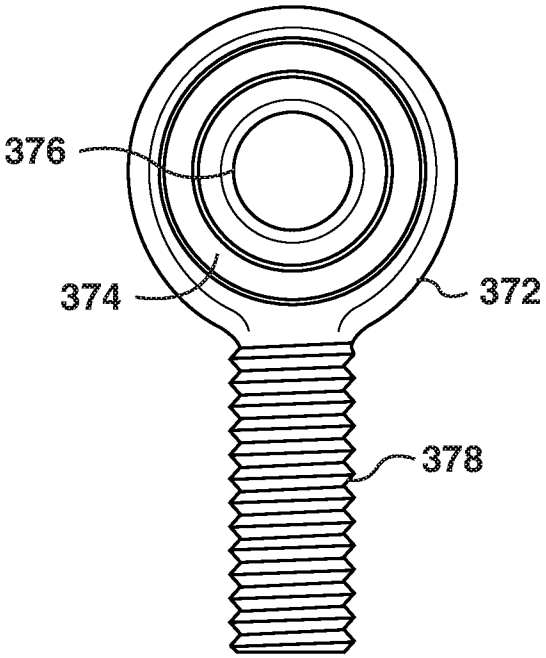
FIG. 10C is a side view showing the joist bracket shown in FIG. 10A.
Figure 10B:
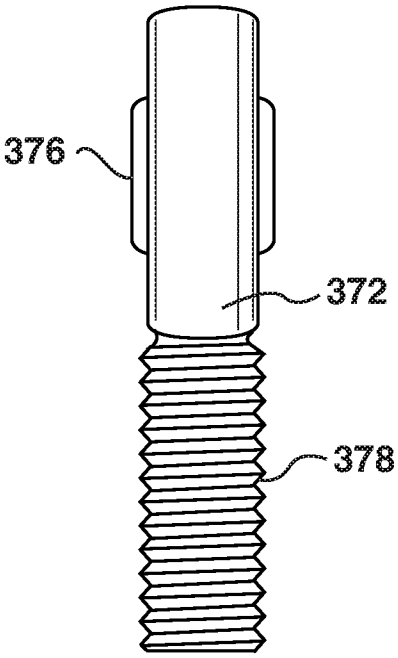
FIG. 10B is an end view showing the joist bracket shown in FIG. 10A.
Figure 10A:
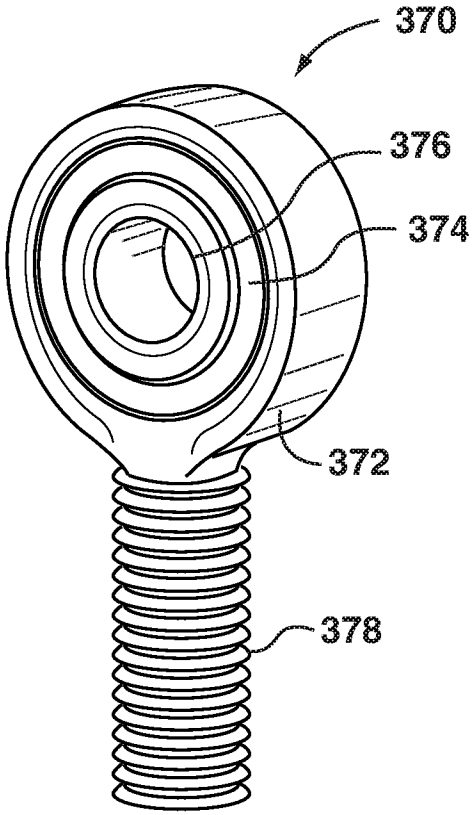
FIG. 10A is a perspective view showing a joist bracket according to an embodiment.
Figure 10D:
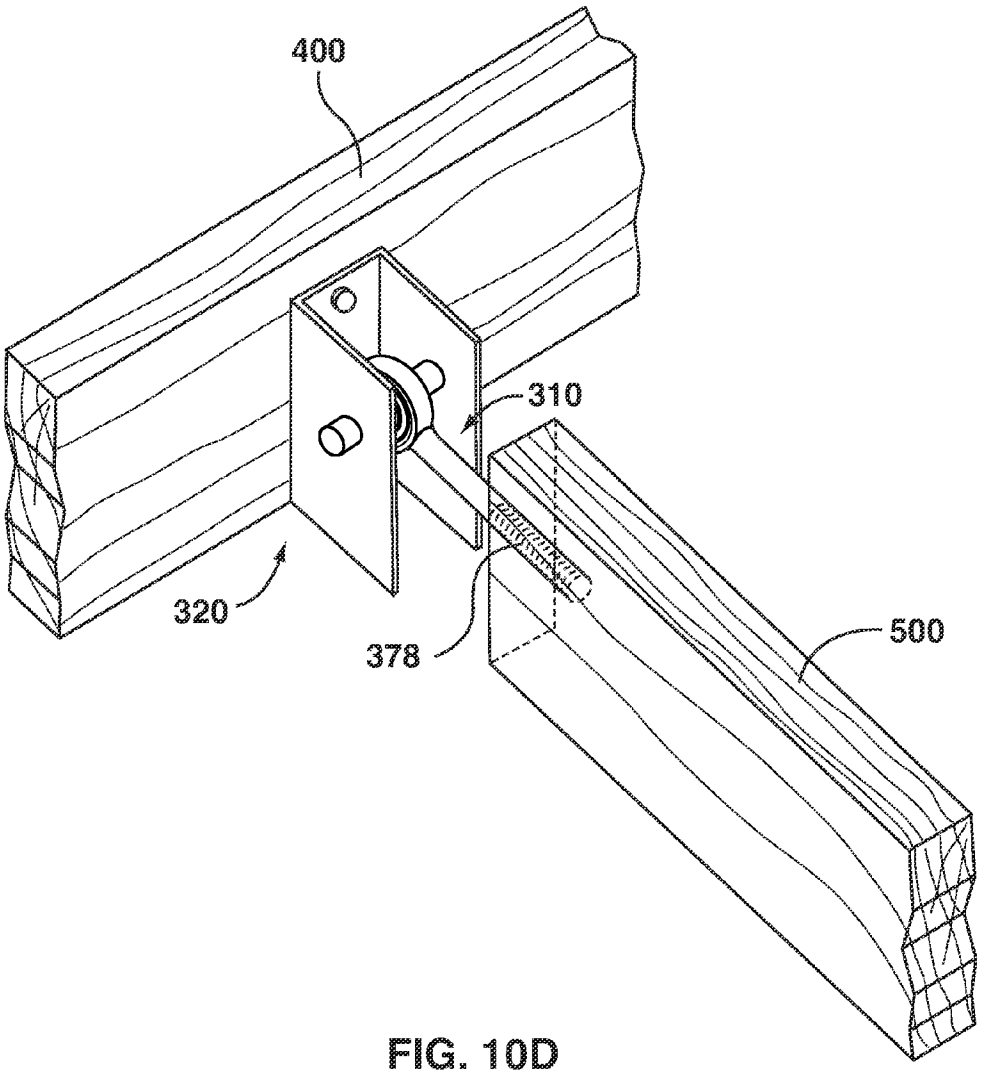
FIG. 10D is a perspective view showing a joist pivotally coupled to a fixed structure using a support hanger assembly according to one embodiment.

As shown in FIGS. 10A-10C, in some embodiments joist bracket 310 may comprise an articulating joint, such as rose joint 370, instead of joist connector ball 316. Rose joint 370 may include casing 372, ball swivel 374, and joist connector bore 376. In some embodiments, rose joint 370 comprises one or more joist plates (not shown). Alternatively (or additionally), rose joint 370 may comprise screw 378. As shown in FIG. 10D, in use screw 378 may be used to fasten joist bracket 310 to joist 500 without the need for joist plates.

To pivotally couple a joist to a fixed structure, typically one would first fasten joist bracket 110 to joist 500, preferably at an end of joist 500, and separately mount support bracket 120 to fixed structure 400. Alternatively, support bracket 120 may be mounted to fixed structure 400 before joist bracket 110 is fastened to joist 500.

Once joist bracket 110 is fastened to joist 500 and support bracket 120 has been mounted to fixed structure 400, joist bracket 110 is positioned relative to support bracket 120 so that joist connector bore(s) 116 and support connector bore(s) 126 are axially aligned.

Once joist connector bore(s) 116 and support connector bore(s) 126 are axially aligned, connecting member 130 is disposed through joist connector bore(s) 116 and support connector bore(s) 126 to pivotally couple the joist bracket 110 to the support bracket 120.

The present invention has been described here by way of example only. Various modification and variations may be made to these exemplary embodiments without departing from the spirit and scope of the invention, which is limited only by the appended claims. For example, the various characteristics which are described by means of the represented embodiments or examples may be selectively combined with each other.

Also, while the examples described above occasionally make reference to specific dimensions or materials, those skilled in the art will understand that any suitable dimensions and/or materials may be selected based on the loading or other requirements of a particular application.

As a further example, while joist plates 114 and support flanges 124 are depicted as substantially solid rectangular members, persons skilled in the art will recognize alternative shapes or configurations (e.g. comprising one or more webs or truss members) may alternatively be used. Accordingly, what has been described above is intended to be illustrative of the claimed concept and non-limiting. It will be understood by persons skilled in the art that variations are possible in variant implementations and embodiments.

We claim:

1. A support hanger assembly for pivotally coupling a joist to a fixed structure, the support hanger assembly comprising:

a joist bracket for fastening to the joist, the joist bracket comprising:

a joist bracket base configured to contact and support a lower horizontal surface of the joist when the joist bracket is fastened to the joist, two joist plates extending substantially perpendicular from the joist bracket base, each of the two joist plates having a joist connector bore, and at least one of the two joist plates having a fastener bore, wherein the joist bracket is configured to be fastened to the joist by disposing a mechanical fastener through the fastener bore and into the joist;

a support bracket comprising:

a support bracket base configured to be mounted to the fixed structure, and at least one flange extending from the support bracket base for coupling to the joist bracket, the at least one flange having a support connector bore; and a connecting member for pivotally coupling the joist bracket and the support bracket;

the support hanger assembly configured such that when:

the joist bracket is fastened to the joist with a mechanical fastener, the support bracket is mounted to the fixed structure, and the joist bracket is pivotally coupled to the support bracket by disposing the connecting member horizontally through the joist connector bores and through the support connector bore, the joist bracket can be pivoted vertically about the connecting member relative to the support bracket without significant torque being transferred to the fixed structure, thereby allowing vertical rotation of the joist and joist bracket relative to the fixed structure.

2. The support hanger assembly of claim 1, wherein the at least one flange comprises at least two flanges, and wherein the at least two flanges are spaced apart for supporting the joist bracket therebetween.

3. The support hanger assembly of claim 1, wherein the connecting member is further disposed through a bore in the joist.

4. The support hanger assembly of claim 1, wherein the connecting member includes a bearing.

5. The support hanger assembly of claim 1, wherein the joist bracket further comprises at least one bearing, and wherein one of the two joist connector bores is an inner bore of the at least one bearing.

6. The support hanger assembly of claim 1, wherein the joist is a floor joist of a deck.

7. A support hanger assembly for pivotally coupling two or more joists to a fixed structure, the support hanger assembly comprising:

two or more joist brackets, each configured to be fastened to one of the two or more joists;

at least two support brackets, each support bracket comprising a support bracket base configured to be mounted to the fixed structure, and at least one flange extending from the support bracket base for coupling to the two or more joist brackets; and a single connecting member for pivotally coupling the two or more joist brackets and the at least two support brackets.

8. The support hanger assembly of claim 7, wherein:

each joist bracket has at least one joist connector bore, each flange includes a support connector bore; and wherein pivotally coupling the two or more joist brackets and the at least two support brackets comprises disposing the single connecting member through the at least one joist connector bore and the support connector bores.

9. The support hanger assembly of claim 8, wherein each of the two or more joist brackets comprises a joist bracket base and a joist plate extending from the joist bracket base, and wherein each joist plate has the at least one the joist connector bore extending therethrough.

10. The support hanger assembly of claim 8, wherein each of the two or more joist brackets comprises a joist bracket base and two joist plates extending from the joist bracket base, and wherein each joist plate has the at least one the joist connector bore extending therethrough.

11. The support hanger assembly of claim 7, configured such that when:

the two or more joist brackets are each fastened to one of the two or more joists, the at least two support brackets are mounted to the fixed structure, and the two or more joist brackets are pivotally coupled to the at least two support brackets, the two or more joist brackets can be pivoted relative to the at least two support brackets without significant torque being transferred to the fixed structure.

12. A method for pivotally coupling a joist to a fixed structure, the method comprising:

fastening a joist bracket to the joist by disposing a mechanical fastener through a fastener bore in the joist bracket and into the joist, the joist bracket having a joist bracket base configured to contact and support a lower horizontal surface of the joist when the joist bracket is fastened to the joist, and at least one joist plate extending substantially perpendicular from the joist bracket base, the at least one joist plate having a joist connector bore;

mounting a support bracket to the fixed structure, the support bracket comprising a support bracket base and at least at least one flange extending from the support bracket base for coupling to the joist bracket, the at least one flange having a support connector bore extending therethrough;

positioning the joist bracket relative to the support bracket so that the joist connector bore and the support connector bore are axially aligned, and disposing a connecting member horizontally through the joist connector bore and the support connector bore to pivotally couple the joist bracket to the support bracket, without fastening the support bracket to the joist, such that the joist bracket can be pivoted vertically about the connecting member relative to the support bracket without significant torque being transferred to the fixed structure, thereby allowing vertical rotation of the joist and joist bracket relative to the fixed structure.

13. The method of claim 12, wherein the at least one joist plate comprises two joist plates.

14. The method of claim 12, wherein the joist is a floor joist of a deck.

15. The method of claim 12, wherein the joist is part of an attached structure selected from the group consisting of: a deck, an awning, a pergola and a dock.

* * * * *